US007589243B1

(12) United States Patent
Ryder

(10) Patent No.: US 7,589,243 B1
(45) Date of Patent: Sep. 15, 2009

(54) JET FUEL COMPOSITIONS

(75) Inventor: Jason A. Ryder, Oakland, CA (US)

(73) Assignee: Amyris Biotechnologies, Inc., Emeryville, CA (US)

( * ) Notice: Subject to any disclaimer, the term of this patent is extended or adjusted under 35 U.S.C. 154(b) by 0 days.

(21) Appl. No.: 12/393,024

(22) Filed: Feb. 25, 2009

Related U.S. Application Data

(60) Provisional application No. 61/097,813, filed on Sep. 17, 2008.

(51) Int. Cl.
*C10L 1/10* (2006.01)

(52) U.S. Cl. ..... 585/14; 400/300

(58) Field of Classification Search ..... 44/300; 585/14

See application file for complete search history.

(56) References Cited

U.S. PATENT DOCUMENTS 7,399,323 B2 7/2008 Renninger et al.

7,540,888 B2 * 6/2009 Ryder et al. ..... 44/451

FOREIGN PATENT DOCUMENTS

WO WO 2008/133658 11/2008

OTHER PUBLICATIONS

Liang,Fuyan et al, The Organic composition of diesel particulate matter, diesel fuel and engine oil of a non-road diesel generator, Aug. 2005,J. Environ. Monit., vol. 7, pp. 983-988.*

Soltes, Hydroprocessing of biomass tars for liquid engine fuels, Progress in Biomass Conversion, 1984, 5, 1-68.

* cited by examiner

*Primary Examiner*—Cephia D Toomer
(74) *Attorney, Agent, or Firm*—Jones Day

(57) ABSTRACT

Provided herein are, among other things, fuel compositions and methods of making and using the same. In some embodiments, the fuel compositions provided herein comprise a mixture of limonane and farnesane. In other embodiments, the fuel compositions provided herein comprise a mixture of limonene, farnesane, p-cymene and a petroleum-based fuel or a Fischer-Tropsch-based fuel. In still other embodiments, the fuel compositions provided herein comprise a mixture of limonene, farnesane, p-cymene, a petroleum-based fuel or a Fischer-Tropsch-based fuel and a fuel additive.

20 Claims, 5 Drawing Sheets

Light Off (Cold Start)

Lean Blowout

JET FUEL COMPOSITIONS

PRIOR RELATED APPLICATIONS

This application claims the benefit of U.S. Provisional Patent Application No. 61/097,813, filed Sep. 17, 2008, and U.S. patent application Ser. No. 12/329,483, filed Dec. 5, 2008, for converting which to U.S. Provisional Application No. 61/196,726, a Request under 37 C.F.R. §1.53(C)(2) for Conversion of Non-Provisional Application to Provisional Application was filed on Jan. 29, 2009, all of which are incorporated herein by reference in their entirety.

FIELD OF THE INVENTION

Provided herein are, among other things, fuel compositions and methods of making and using the same. In some embodiments, the fuel compositions comprise at least a fuel component readily and efficiently produced, at least in part, from a microorganism. In certain embodiments, the fuel compositions provided herein comprise a high concentration of at least a bioengineered fuel component. In further embodiments, the fuel compositions provided herein comprise limonane and farnesane.

BACKGROUND OF THE INVENTION

Biofuels include fuels derived from biomass, e.g., recently living organisms or their metabolic byproducts, such as manure from animals. Biofuels are desirable because they can be renewable energy sources, unlike other natural resources such as petroleum, coal and nuclear fuels. A biofuel that is suitable for use as jet fuel has yet to be introduced. The present invention provides such biofuels.

SUMMARY OF THE INVENTION

Provided herein are, among other things, fuel compositions comprising limonane and farnesane and methods of making and using the same. In certain embodiments, the fuel composition comprises a fuel component readily and efficiently produced, at least in part, from a microorganism.

In one aspect, provided herein is a fuel composition comprising limonane and farnesane wherein each of the limonane and farnesane is in an amount that is at least embodiments, the density of the fuel composition disclosed herein at 15° C. is between about 775 kg/m$^3$ and about 840 kg/m$^3$ or from about 775 kg/m$^3$ to about 840 kg/m$^3$. In some embodiments, the fuel composition disclosed herein further comprises p-cymene in an amount that is at least 0.5% by volume, based on the total volume of the fuel composition. In other embodiments, the fuel composition disclosed herein further comprises a petroleum-based fuel or a synthetic fuel, e.g., a Fischer-Tropsch-based fuel, in an amount that is at least 10% by volume, based on the total volume of the fuel composition.

In another aspect, provided herein is a fuel composition comprising (a) limonane in an amount that is between about 15% and about 60% by volume or from about 15% to about 60% by volume; (b) farnesane in an amount that is between about 5% and about 45% by volume or from about 5% to about 45% by volume; (c) p-cymene in an amount that is from about 0.5% to about 25% by volume; and (d) a petroleum-based fuel or a synthetic fuel, e.g., a Fischer-Tropsch-based fuel, in an amount that is at least 20% by volume, wherein the amounts are based on the total volume of the fuel composition.

In another aspect, provided herein is a fuel composition comprising (a) limonane in an amount that is between about 15% and about 30% by volume or from about 15% to about 30% by volume; (b) farnesane in an amount that is between about 10% and about 30% by volume or from about 10% to about 30% by volume; (c) p-cymene in an amount that is from about 0.5% to about 20% by volume; (d) a petroleum-based fuel or a synthetic fuel, e.g., a Fischer-Tropsch-based fuel, in an amount that is at least 40% by volume; and (e) a fuel additive, wherein the amounts are based on the total volume of the fuel composition.

In certain embodiments, the fuel composition disclosed herein has a density from about 750 kg/m$^3$ to about 840 kg/m$^3$ at 15° C. In certain embodiments, the fuel composition has a difference between $T_{90}$ and $T_{10}$ temperatures of at least 10° C. In certain embodiments, the fuel composition disclosed herein has a density from about 750 kg/m$^3$ to about 840 kg/m$^3$ at 15° C., and the fuel composition disclosed herein has a difference between $T_{90}$ and $T_{10}$ temperatures of at least 10° C.

In another aspect, provided herein is a fuel composition consisting essentially of limonane, farnesane and cymene.

In another aspect, provided herein is a vehicle comprising an internal combustion engine; a fuel tank connected to the internal combustion engine; and a fuel composition disclosed herein in the fuel tank, wherein the fuel composition is used to power the internal combustion engine. In some embodiments, the internal combustion engine is a jet engine.

In some embodiments, the limonane in the fuel compositions disclosed herein is or comprises

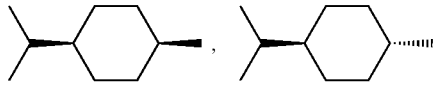

or a combination thereof.

In some embodiments, the farnesane in the fuel compositions disclosed herein is or comprises

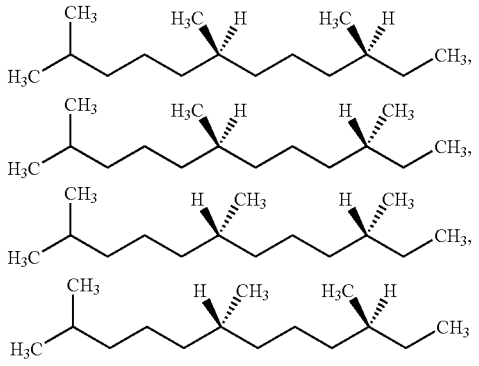

or a combination thereof.

In some embodiments, the fuel compositions disclosed herein is a petroleum-based fuel or a synthetic fuel. In further embodiments, the petroleum-based fuel in the fuel compositions disclosed herein is selected from kerosene, Jet A, Jet A-1, Jet B and combinations thereof. In other embodiments, the synthetic fuel is or comprises a Fischer-Tropsch-based fuel. In further embodiments, the Fischer-Tropsch-based fuel is or comprises SASOL CTL synthetic jet fuel. In some embodiments, the fuel compositions disclosed herein meet the ASTM D 1655 specification for Jet A, Jet A-1 or Jet B. In other embodiments, the fuel composition disclosed herein meets the Defence Standard 91-91 specification for SASOL CTL synthetic jet fuel.

In some embodiments, the fuel compositions disclosed herein further comprise a fuel additive. In other embodiments, the fuel additive is at least one additive selected from the group consisting of an oxygenate, an antioxidant, a thermal stability improver, a stabilizer, a cold flow improver, a combustion improver, an anti-foam, an anti-haze additive, a corrosion inhibitor, a lubricity improver, an icing inhibitor, an injector cleanliness additive, a smoke suppressant, a drag reducing additive, a metal deactivator, a dispersant, a detergent, a de-emulsifier, a dye, a marker, a static dissipater, a biocide, and combinations thereof. In further embodiments, the fuel additive is an antioxidant.

DEFINITIONS

Figure 1:
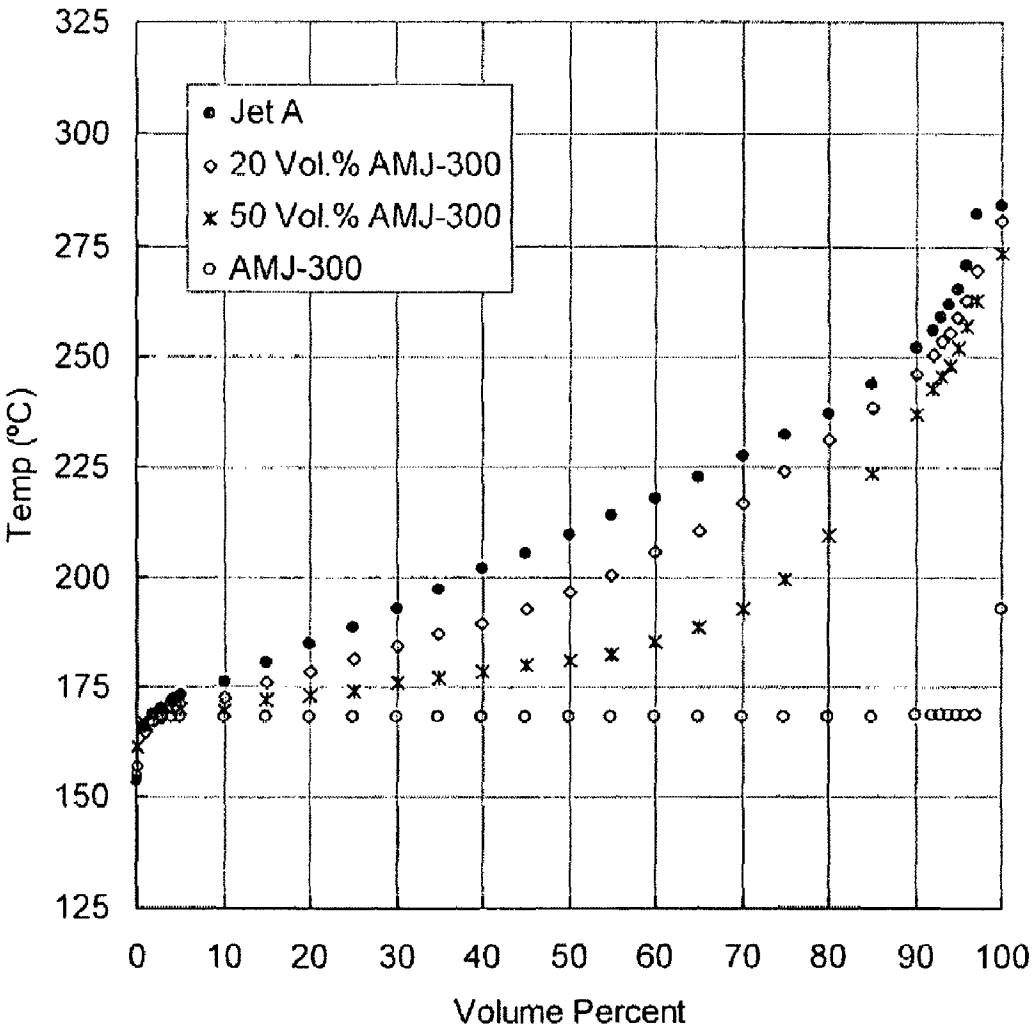
FIG. 1 shows distillation curves for a Jet A and certain blends of Jet A and AMJ-300.

The ASTM D 1655 specifications, published by ASTM International, set certain minimum acceptance requirements for Jet A, Jet A-1, and Jet B.

"Bioengineered compound" refers to a compound made by a host cell, including any archae, bacterial, or eukaryotic cells or microorganism.

"Biofuel" refers to any fuel that is derived from a biomass, i.e., recently living organisms or their metabolic byproducts, such as manure from cows. It is a renewable energy source, unlike other natural resources such as petroleum, coal and nuclear fuels.

"Density" refers to a measure of mass per volume at a particular temperature. The generally accepted method for measuring the density of a fuel is ASTM Standard D 4052, which is incorporated herein by reference.

"Doctor Test" is for the detection of mercaptans in petroleum-based fuels such as jet fuel and kerosene. This test may also provide information on hydrogen sulfide and elemental sulfur that may be present in the fuels. The generally accepted method for measuring the freezing point of a fuel is ASTM Standard D 4952, which is incorporated herein by reference.

"Farnesane" refers to a compound having formula

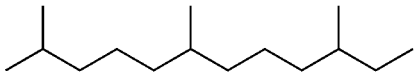

or a stereoisomer thereof. In some embodiments, the farnesane comprises a substantially pure stereoisomer of farnesane. In other embodiments, the farnesane comprises a mixture of stereoisomers, such as enantiomers and diastereoisomers, of farnesane. In further embodiments, the amount of each of the stereoisomers in the farnesane mixture is independently from about 0.1 wt. % to about 99.9 wt. %, from about 0.5 wt. % to about 99.5 wt. %, from about 1 wt. % to about 99 wt. %, from about 5 wt. % to about 95 wt. %, from about 10 wt. % to about 90 wt. %, from about 20 wt. % to about 80 wt. %, based on the total weight of the farnesane mixture.

"Flash point" refers to the lowest temperature at which the vapors above a flammable liquid will ignite in the air on the application of an ignition source. Generally, every flammable liquid has a vapor pressure, which is a function of the temperature of the liquid. As the temperature increases, the vapor pressure of the liquid increases. As the vapor pressure increases, the concentration of the evaporated liquid in the air increases. At the flash point temperature, just enough amount of the liquid has vaporized to bring the vapor-air space over the liquid above the lower flammability limit. For example, the flash point of gasoline is about −43° C. which is why gasoline is so highly flammable. For safety reasons, it is desirable to have much higher flash points for fuel that is contemplated for use in jet engines. The generally accepted methods for measuring the flash point of a fuel are ASTM Standard D 56, ASTM Standard D 93, ASTM Standard D 3828-98, all of which are incorporated herein by reference.

"Freezing point" refers to the temperature at which the last wax crystal melts, when warming a fuel that has been previously been cooled until waxy crystals form. The generally accepted method for measuring the freezing point of a fuel is ASTM Standard D 2386, which is incorporated herein by reference.

"Fuel" refers to one or more hydrocarbons, one or more alcohols, one or more fatty esters or a mixture thereof. Preferably, liquid hydrocarbons are used. Fuel can be used to power internal combustion engines such as reciprocating engines (e.g., gasoline engines and diesel engines), Wankel engines, jet engines, some rocket engines, missile engines and gas turbine engines. In some embodiments, fuel typically comprises a mixture of hydrocarbons such as alkanes, cycloalkanes and aromatic hydrocarbons. In other embodiments, fuel comprises limonane.

"Fuel additive" refers to chemical components added to fuels to alter the properties of the fuel, e.g., to improve engine performance, fuel handling, fuel stability, or for contaminant control. Types of additives include, but are not limited to, antioxidants, thermal stability improvers, cetane improvers, stabilizers, cold flow improvers, combustion improvers, anti-foams, anti-haze additives, corrosion inhibitors, lubricity improvers, icing inhibitors, injector cleanliness additives, smoke suppressants, drag reducing additives, metal deactivators, dispersants, detergents, demulsifiers, dyes, markers, static dissipaters, biocides and combinations thereof. The term "conventional additives" refers to fuel additives known to skilled artisan, such as those described above, and does not include limonane.

"Fuel component" refers to any compound or a mixture of compounds that are used to formulate a fuel composition. There are "major fuel components" and "minor fuel components." A major fuel component is present in a fuel composition by at least 50% by volume; and a minor fuel component is present in a fuel composition by less than 50%. Fuel additives are minor fuel components. In certain embodiments, limonane can be a major component or a minor component, or in a mixture with other fuel components.

"Fuel composition" refers to a fuel that comprises at least two fuel components.

"Isoprenoid" and "isoprenoid compound" are used interchangeably herein and refer to a compound derivable from isopentenyl diphosphate.

"Isoprenoid starting material" refers to an isoprenoid compound from which limonane can be made.

"Jet fuel" refers to a fuel suitable for use in a jet engine.

"Kerosene" refers to a specific fractional distillate of petroleum (also known as "crude oil"), generally between about 150° C. and about 275° C. at atmospheric pressure. Crude oils are composed primarily of hydrocarbons of the paraffinic, naphthenic, and aromatic classes.

"Limonane" refers to a compound of the following formula

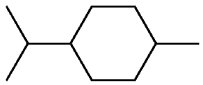

or stereoisomers thereof. In some embodiments, the limonane comprises a substantially pure stereoisomer of limonane. In other embodiments, the limonane comprises a mixture of stereoisomers, such as enantiomers and diastereoisomers, of limonane. In further embodiments, the amount of each of the stereoisomers in the limonane mixture is independently from about 0.1 wt. % to about 99.9 wt. %, from about 0.5 wt. % to about 99.5 wt. %, from about 1 wt. % to about 99 wt. %, from about 5 wt. % to about 95 wt. %, from about 10 wt. % to about 90 wt. %, from about 20 wt. % to about 80 wt. %, based on the total weight of the limonane mixture.

"Missile fuel" refers to a fuel suitable for use in a missile engine.

"p-Cymene" refers to the following compound

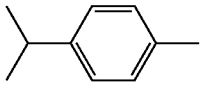

"Petroleum-based fuel" refers to a fuel that includes a fractional distillate of petroleum.

"Synthetic fuel" refers to any liquid fuel obtained from coal, natural gas, or biomass.

"Smoke Point" refers to the point in which a fuel or fuel composition is heated until it breaks down and smokes. The generally accepted method for measuring the smoke point of a fuel is ASTM Standard D 1322, which is incorporated herein by reference.

"Viscosity" refers to a measure of the resistance of a fuel or fuel composition to deform under shear stress. The generally accepted method for measuring the viscosity of a fuel is ASTM Standard D 445, which is incorporated herein by reference.

As used herein, a composition that is a "substantially pure" compound is substantially free of one or more other compounds, i.e., the composition contains greater than 80 vol. %, greater than 90 vol. %, greater than 95 vol. %, greater than 96 vol. %, greater than 97 vol. %, greater than 98 vol. %, greater than 99 vol. %, greater than 99.5 vol. %, greater than 99.6 vol. %, greater than 99.7 vol. %, greater than 99.8 vol. %, or greater than 99.9 vol. % of the compound; or less than 20 vol. %, less than 10 vol. %, less than 5 vol. %, less than 3 vol. %, less than 1 vol. %, less than 0.5 vol. %, less than 0.1 vol. %, or less than 0.01 vol. % of the one or more other compounds, based on the total volume of the composition.

As used herein, a composition that is "substantially free" of a compound means that the composition contains less than 20 vol. %, less than 10 vol. %, less than 5 vol. %, less than 4 vol. %, less than 3 vol. %, less than 2 vol. %, less than 1 vol. %, less than 0.5 vol. %, less than 0.1 vol. %, or less than 0.01 vol. % of the compound, based on the total volume of the composition.

As used herein, the term "stereochemically pure" means a composition that comprises one stereoisomer of a compound and is substantially free of other stereoisomers of that compound. For example, a stereomerically pure composition of a compound having one chiral center will be substantially free of the opposite enantiomer of the compound. A stereomerically pure composition of a compound having two chiral centers will be substantially free of other diastereomers of the compound. A typical stereomerically pure compound comprises greater than about 80% by weight of one stereoisomer of the compound and less than about 20% by weight of other stereoisomers of the compound, more preferably greater than about 90% by weight of one stereoisomer of the compound and less than about 10% by weight of the other stereoisomers of the compound, even more preferably greater than about 95% by weight of one stereoisomer of the compound and less than about 5% by weight of the other stereoisomers of the compound, and most preferably greater than about 97% by weight of one stereoisomer of the compound and less than about 3% by weight of the other stereoisomers of the compound.

As used herein, the term "enantiomerically pure" means a stereomerically pure composition of a compound having one chiral center.

As used herein, the term "racemic" or "racemate" means about 50% of one enantiomer and about 50% of the corresponding enantiomer relative to all chiral centers in the molecule. The invention encompasses all enantiomerically pure, enantiomerically enriched, diastereomerically pure, diastereomerically enriched, and racemic mixtures of the compounds of the invention.

In addition to the definitions above, certain compounds described herein have one or more double bonds that can exist as either the Z or E isomer. In certain embodiments, compounds described herein are present as individual isomers substantially free of other isomers and alternatively, as mixtures of various isomers, e.g., racemic mixtures of stereoisomers.

In the following description, all numbers disclosed herein are approximate values, regardless whether the word "about" or "approximate" is used in connection therewith. They may vary by 1 percent, 2 percent, 5 percent, or, sometimes, 10 to 20 percent. Whenever a numerical range with a lower limit, $R^L$, and an upper limit, $R^U$, is disclosed, any number falling within the range is specifically disclosed. In particular, the following numbers within the range are specifically disclosed: $R=R^L+k*(R^U-R^L)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed.

DESCRIPTION OF EMBODIMENTS OF THE INVENTION

In one aspect, the invention provides a fuel composition comprising:

(a) limonane in an amount that is at least 5% by volume, based on the total volume of the fuel composition; and (b) farnesane in an amount that is at least 5% by volume, based on the total volume of the fuel composition.

In certain embodiments, the density of the fuel composition at 15° C. is between about 775 kg/m$^3$ and about 840 kg/m$^3$. In certain embodiments, the difference between $T_{90}$ (90% recovery temperature) and $T_{10}$ (10% recovery temperature) of the fuel composition is greater than 10° C., is greater than 20° C., is greater than 30° C., is greater than 40° C., or is greater than 50° C. In certain embodiments, the density of the fuel composition at 15° C. is between about 775 kg/m$^3$ and about 840 kg/m$^3$, and the difference between $T_{90}$ and $T_{10}$ of the fuel composition is greater than 10° C., is greater than 20° C., is greater than 30° C., is greater than 40° C., or is greater than 50° C.

In certain embodiments, the amount of limonane is from about 5% to about 90%, from about 5% to about 80%, from about 5% to about 70% or from about 5% to about 50% by weight or volume, based on the total weight or volume of the fuel composition. In certain embodiments, the amount of limonane is at least about 10%, 15%, 20%, 25%, 30%, 35%, 40%, 45%, 50%, 55%, 60%, 65%, 70%, 75%, 80%, 85%, 90% or 95% by weight or volume, based on the total weight or volume of the fuel composition. In certain embodiments, the amount is in weight % based on the total weight of the fuel composition. In other embodiments, the amount is in volume % based on the total volume of the fuel composition.

In other embodiments, limonane is present in an amount of at most about 10%, at most about 15%, at most about 20%, at most about 25%, at most about 30%, at most about 35%, at most about 40%, at most about 45%, at most about 50%, at most about 60%, at most about 70%, at most about 80%, or at most about 90% by weight or volume, based on the total weight or volume of the fuel composition. In further embodiments, limonane is present in an amount from about 5% to about 90%, from about 7.5% to about 85%, from about 10% to about 80%, from about 15% to about 80%, from about 20% to about 75%, from about 25% to about 60%, or from about 30% to about 50% by weight or volume, based on the total weight or volume of the fuel composition. In certain embodiments, the amount is in weight % based on the total weight of the fuel composition. In other embodiments, the amount is in volume % based on the total volume of the fuel composition.

In some embodiments, the limonane in the fuel compositions disclosed herein is or comprises

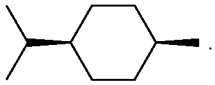

In other embodiments, the limonane in the fuel compositions disclosed herein is or comprises

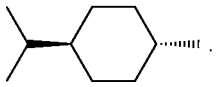

In still other embodiments, the limonane in the fuel compositions disclosed herein is or comprises a mixture comprising:

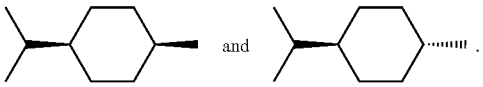

In some embodiments, limonane is derived from an isoprenoid starting material. In certain embodiments, the isoprenoid starting material is made by host cells by converting a carbon source into the isoprenoid starting material.

In certain embodiments, the amount of farnesane is from about 5% to about 70%, from about 5% to about 60%, from about 5% to about 50%, from about 5% to about 40%, from about 5% to about 30%, from about 10% to about 30%, from about 5% to about 25%, from about 10% to about 25%, from about 5% to about 35%, or from about 10% to about 35% by weight or volume, based on the total weight or volume of the fuel composition. In other embodiments, the amount of farnesane is at most about 5%, 6%, 7%, 8%, 9%, 10%, 11%, 12%, 13%, 14%, 15%, 16%, 17%, 18%, 19%, 20%, 30%, 35%, 40%, 45%, 50%, 55%, or 60% by weight or volume, based on the total weight or volume of the fuel composition. In further embodiments, the amount of farnesane is at least about 5%, 6%, 7%, 8%, 9%, 10%, 11%, 12%, 13%, 14%, 15%, 16%, 17%, 18%, 19%, 20%, 30%, 35%, 40%, 45%, 50%, 55%, or 60% by weight or volume, based on the total weight or volume of the fuel composition. In some embodiments, the amount is in weight % based on the total weight of the fuel composition. In other embodiments, the amount is in volume % based on the total volume of the fuel composition.

In other embodiments, the farnesane in the fuel compositions disclosed herein is or comprises

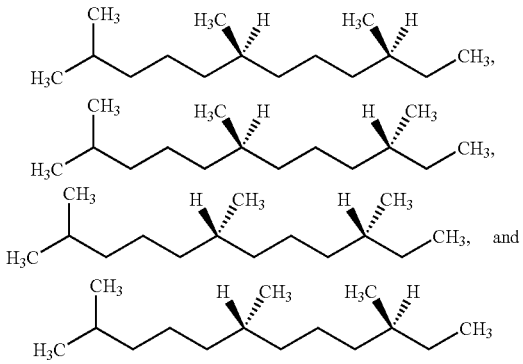

or a combination thereof.

In some embodiments, farnesane is derived from an isoprenoid starting material. In certain embodiments, the isoprenoid starting material is made by host cells by converting a carbon source into the isoprenoid starting material.

In other embodiments, the fuel compositions disclosed herein further comprise cymene in an amount that is at least 0.5% by weight or volume, based on the total weight or volume of the fuel composition. In some embodiments, cymene disclosed herein can be any naturally occurring aromatic organic compound comprising a benzene ring substituted with a methyl group and an isopropyl group. In other embodiments, cymene is p-cymene, m-cymene, o-cymene or a combination thereof. In certain embodiments, the fuel compositions disclosed herein further comprise an aromatic compound in an amount that is at least 0.5% by weight or volume, based on the total weight or volume of the fuel composition. In certain embodiments, the aromatic compound is or comprises p-cymene. Commercial available cymene can be obtained from Acros Organics, Sigma-Aldrich or International Laboratory USA.

In further embodiments, the amount of p-cymene is from about 0.5% to about 40% by volume or weight, from about 0.5% to about 35% by volume or weight, from about 0.5% to about 30% by volume or weight, from about 0.5% to about 25% by volume or weight, from about 0.5% to about 20% by volume or weight, from about 0.5% to about 15% by volume or weight, based on the total volume or weight of the fuel composition. In other embodiments, the amount of p-cymene is from about 1% to about 35% by volume or weight, based on the total volume or weight of the fuel composition. In still other embodiments, the amount of p-cymene is from about 1% to about 25%, from about 5% to about 25%, from about 1% to about 20%, from about 5 to about 20%, or 10% to about 20% by volume or weight, based on the total volume or weight of the fuel composition.

In some embodiments, the total amount of aromatic compounds (including any cymene) in the fuel compositions is from about 1% to about 50% by weight or volume, based on the total weight or volume of the fuel composition. In other embodiments, the total amount of aromatic compounds in the fuel compositions is from about 15% to about 35% by weight or volume, based on the total weight or volume of the fuel compositions. In further embodiments, the total amount of aromatic compounds in the fuel compositions is from about 15% to about 25% by weight or volume, based on the total weight or volume of the fuel compositions. In other embodiments, the total amount of aromatic compounds in the fuel compositions is from about 5% to about 10% by weight or volume, based on the total weight or volume of the fuel composition. In still further embodiments, the total amount of aromatic compounds in the fuel compositions is less than about 25% by weight or volume, based on the total weight or volume of the fuel compositions.

In other embodiments, the fuel composition further comprises a petroleum-based fuel. The amount of the petroleum-based fuel in the fuel composition disclosed herein may be from about 5% to about 90%, from about 5% to about 85%, from about 5% to about 80%, from about 5% to about 70%, from about 5% to about 60%, or from about 5% to about 50%, based on the total amount of the fuel composition. In certain embodiments, the amount of the petroleum-based fuel is less than about 95%, less than about 90%, less than about 85%, less than about 75%, less than about 70%, less than about 65%, less than about 60%, less than about 55%, less than about 50%, less than about 45%, less than about 40%, less than about 35%, less than about 30%, less than about 25%, less than about 20%, less than about 15%, less than about 10%, based on the total amount of the fuel composition. In other embodiments, the petroleum based fuel is at least about 20%, at least about 30%, at least about 40%, at least about 50%, at least about 60%, at least about 70%, at least about 80% based on the total amount of the fuel composition. In some embodiments, the amount is in wt. % based on the total weight of the fuel composition. In other embodiments, the amount is in vol. % based on the total volume of the fuel composition.

In some embodiments, the petroleum-based fuel is kerosene. Conventional kerosene generally is a mixture of hydrocarbons, having a boiling point from about 285° F. to about 610° F. (i.e., from about 140° C. to about 320° C.).

In other embodiments, the petroleum-based fuel is a jet fuel. Any jet fuel known to skilled artisans can be used herein. The American Society for Testing and Materials ("ASTM") and the United Kingdom Ministry of Defense ("MOD") have taken the lead roles in setting and maintaining specification for civilian aviation turbine fuel or jet fuel. The respective specifications issued by these two organizations are very similar but not identical. Many other countries issue their own national specifications for jet fuel but are very nearly or completely identical to either the ASTM or MOD specification. ASTM D 1655 is the Standard Specification for Aviation Turbine Fuels and includes specifications for Jet A, Jet A-1 and Jet B fuels. Defence Standard 91-91 is the MOD specification for Jet A-1.

Jet A-1 is the most common jet fuel and is produced to an internationally standardized set of specifications. In the United States only, a version of Jet A-1 known as Jet A is also used. Another jet fuel that is commonly used in civilian aviation is called Jet B. Jet B is a lighter fuel in the naptha-kerosene region that is used for its enhanced cold-weather performance. Jet A, Jet A-1 and Jet B are specified in ASTM Specification D 1655.

Alternatively, jet fuels are classified by militaries around the world with a different system of JP numbers. Some are almost identical to their civilian counterparts and differ only by the amounts of a few additives. For example, Jet A-1 is similar to JP-8 and Jet B is similar to JP-4.

In some embodiments, the fuel composition further comprises a synthetic fuel. Any synthetic fuel obtained from coal, natural gas, or biomass can be used herein. In further embodiments, the synthetic fuel comprises a Fischer-Tropsch-based fuel, a Bergius-based fuel, a Mobil-based fuel, a Karrick-based fuel, or a combination thereof. In still further embodiments, the synthetic fuel comprises a Coal-To-Liquids-based fuel (CTL-based fuel), a Gas-To-Liquids based fuel (GTL-based fuel), a Biomass-To-Liquids based fuel (BTL-based fuel), a Coal and Biomass To Liquids based fuel (CBTL-based fuel), or a combination thereof.

In certain embodiments, the synthetic fuel further comprises a Fischer-Tropsch-based fuel. In other embodiments, the synthetic fuel further comprises a Bergius-based fuel. In still other embodiments, the synthetic fuel further comprises a Mobil-based fuel. In still other embodiments, the synthetic fuel further comprises a Karrick-based fuel.

In certain embodiments, the synthetic fuel further comprises a CTL-based fuel. In other embodiments, the synthetic fuel further comprises a GTL-based fuel. In still other embodiments, the synthetic fuel further comprises a BTL-based fuel. In still other embodiments, the synthetic fuel further comprises a CBTL-based fuel.

In some embodiments, the synthetic fuel is a Fischer-Tropsch-based fuel. In certain embodiments, the Fischer-Tropsch-based fuel is or comprises various forms of liquid hydrocarbons produced by a catalyzed chemical reaction of a mixture of carbon monoxide and hydrogen.

Any Fischer-Tropsch catalyst can be used herein. Some non-limiting examples of suitable catalysts for the preparation of the Fischer-Tropsch-based fuel are cobalt, iron, nickel and ruthenium.

In certain embodiments, the fuel composition further comprises a synthetic fuel. The amount of the synthetic fuel in the fuel composition disclosed herein may be from about 5% to about 90%, from about 5% to about 85%, from about 5% to about 80%, from about 5% to about 70%, from about 5% to about 60%, or from about 5% to about 50%, based on the total amount of the fuel composition. In certain embodiments, the amount of the synthetic fuel is less than about 95%, less than about 90%, less than about 85%, less than about 75%, less than about 70%, less than about 65%, less than about 60%, less than about 55%, less than about 50%, less than about 45%, less than about 40%, less than about 35%, less than about 30%, less than about 25%, less than about 20%, less than about 15%, less than about 10%, based on the total amount of the fuel composition. In other embodiments, the synthetic fuel is at least about 20%, at least about 30%, at least about 40%, at least about 50%, at least about 60%, at least about 70%, at least about 80% based on the total amount of the fuel composition. In some embodiments, the amount is in wt. % based on the total weight of the fuel composition. In other embodiments, the amount is in vol. % based on the total volume of the fuel composition.

A useful non-limiting example of Fischer-Tropsch-based fuel known as SASOL CTL synthetic jet fuel is used in South Africa and is specified in Defence Standard 91-91.

In some embodiments, the fuel composition further comprises a fuel additive. In certain embodiments, the fuel additive is from about 0.1% to about 50% by weight or volume, based on the total weight or volume of the fuel composition. The fuel additive can be any fuel additive known to those of skill in the art. In further embodiments, the fuel additive is selected from the group consisting of oxygenates, antioxidants, thermal stability improvers, stabilizers, cold flow improvers, combustion improvers, anti-foams, anti-haze additives, corrosion inhibitors, lubricity improvers, icing inhibitors, injector cleanliness additives, smoke suppressants, drag reducing additives, metal deactivators, dispersants, detergents, de-emulsifiers, dyes, markers, static dissipaters, biocides and combinations thereof.

The amount of a fuel additive in the fuel composition disclosed herein may be from about 0.1% to less than about 50%, from about 0.2% to about 40%, from about 0.3% to about 30%, from about 0.4% to about 20%, from about 0.5% to about 15% or from about 0.5% to about 10%, based on the total amount of the fuel composition. In certain embodiments, the amount of a fuel additive is less than about 50%, less than about 45%, less than about 40%, less than about 35%, less than about 30%, less than about 25%, less than about 20%, less than about 15%, less than about 10%, less than about 5%, less than about 4%, less than about 3%, less than about 2%, less than about 1% or less than about 0.5%, based on the total amount of the fuel composition. In some embodiments, the amount is in wt. % based on the total weight of the fuel composition. In other embodiments, the amount is in vol. % based on the total volume of the fuel composition.

Illustrative examples of fuel additives are described in greater detail below. Lubricity improvers are one example. In certain additives, the concentration of the lubricity improver in the fuel falls in the range from about 1 ppm to about 50,000 ppm, preferably from about 10 ppm to about 20,000 ppm, and more preferably from about 25 ppm to about 10,000 ppm. Some non-limiting examples of lubricity improver include esters of fatty acids.

Stabilizers improve the storage stability of the fuel composition. Some non-limiting examples of stabilizers include tertiary alkyl primary amines. The stabilizer may be present in the fuel composition at a concentration from about 0.001 wt. % to about 2 wt. %, based on the total weight of the fuel composition, and in one embodiment from about 0.01 wt. % to about 1 wt. %.

Combustion improvers increase the mass burning rate of the fuel composition. Some non-limiting examples of combustion improvers include ferrocene(dicyclopentadienyl iron), iron-based combustion improvers (e.g., TURBOTECT™ ER-18 from Turbotect (USA) Inc., Tomball, Tex.), barium-based combustion improvers, cerium-based combustion improvers, and iron and magnesium-based combustion improvers (e.g., TURBOTECT™ 703 from Turbotect (USA) Inc., Tomball, Tex.). The combustion improver may be present in the fuel composition at a concentration from about 0.001 wt. % to about 1 wt. %, based on the total weight of the fuel composition, and in one embodiment from about 0.01 wt. % to about 1 wt. %.

Antioxidants prevent the formation of gum depositions on fuel system components caused by oxidation of fuels in storage and/or inhibit the formation of peroxide compounds in certain fuel compositions can be used herein. The antioxidant may be present in the fuel composition at a concentration from about 0.001 wt. % to about 5 wt. %, based on the total weight of the fuel composition, and in one embodiment from about 0.01 wt. % to about 1 wt. %.

Static dissipaters reduce the effects of static electricity generated by movement of fuel through high flow-rate fuel transfer systems. The static dissipater may be present in the fuel composition at a concentration from about 0.001 wt. % to about 5 wt. %, based on the total weight of the fuel composition, and in one embodiment from about 0.01 wt. % to about 1 wt. %.

Corrosion inhibitors protect ferrous metals in fuel handling systems such as pipelines, and fuel storage tanks, from corrosion. In circumstances where additional lubricity is desired, corrosion inhibitors that also improve the lubricating properties of the composition can be used. The corrosion inhibitor may be present in the fuel composition at a concentration from about 0.001 wt. % to about 5 wt. %, based on the total weight of the fuel composition, and in one embodiment from about 0.01 wt. % to about 1 wt. %.

Fuel system icing inhibitors (also referred to as anti-icing additive) reduce the freezing point of water precipitated from jet fuels due to cooling at high altitudes and prevent the formation of ice crystals which restrict the flow of fuel to the engine. Certain fuel system icing inhibitors can also act as a biocide. The fuel system icing inhibitor may be present in the fuel composition at a concentration from about 0.001 wt. % to about 5 wt. %, based on the total weight of the fuel composition, and in one embodiment from about 0.01 wt. % to about 1 wt. %.

Biocides are used to combat microbial growth in the fuel composition. The biocide may be present in the fuel composition at a concentration from about 0.001 wt. % to about 5 wt. %, based on the total weight of the fuel composition, and in one embodiment from about 0.01 wt. % to about 1 wt. %.

Metal deactivators suppress the catalytic effect of some metals, particularly copper, have on fuel oxidation. The metal deactivator may be present in the fuel composition at a concentration from about 0.001 wt. % to about 5 wt. %, based on the total weight of the fuel composition, and in one embodiment from about 0.01 wt. % to about 1 wt. %.

Thermal stability improvers are use to inhibit deposit formation in the high temperature areas of the aircraft fuel system. The thermal stability improver may be present in the fuel composition at a concentration from about 0.001 wt. % to about 5 wt. %, based on the total weight of the fuel composition, and in one embodiment from about 0.01 wt. % to about 1 wt. %.

In some embodiments, the fuel composition has a flash point greater than about 32° C., greater than about 33° C., greater than about 34° C., greater than about 35° C., greater than about 36° C., greater than about 37° C., greater than about 38° C., greater than about 39° C., greater than about 40° C., greater than about 41° C., greater than about 42° C., greater than about 43° C., or greater than about 44° C. In other embodiments, the fuel composition has a flash point greater than 38° C. In certain embodiments, the flash point of the fuel composition disclosed herein is measured according to ASTM Standard D 56. In other embodiments, the flash point of the fuel composition disclosed herein is measured according to ASTM Standard D 93. In further embodiments, the flash point of the fuel composition disclosed herein is measured according to ASTM Standard D 3828-98. In still further embodiments, the flash point of the fuel composition disclosed herein is measured according to any conventional method known to a skilled artisan for measuring flash point of fuels.

In some embodiments, the fuel composition has a density at 15° C. from about 750 kg/m$^3$ to about 850 kg/m$^3$, from about 750 kg/m$^3$ to about 845 kg/m$^3$, from about 750 kg/m$^3$ to about 840 kg/m$^3$, from about 760 kg/m$^3$ to about 845 kg/m$^3$, from about 770 kg/m$^3$ to about 850 kg/m$^3$, from about 770 kg/m$^3$ to about 845 kg/m$^3$, from about 775 kg/m$^3$ to about 850 kg/m$^3$, or from about 775 kg/m$^3$ to about 845 kg/m$^3$. In other embodiments, the fuel composition has a density at 15° C. from about 780 kg/m$^3$ to about 845 kg/m$^3$. In still other embodiments, the fuel composition has a density at 15° C. from about 775 kg/m$^3$ to about 840 kg/m$^3$. In still other embodiments, the fuel composition has a density at 15° C. from about 750 kg/m$^3$ to about 805 kg/m$^3$. In certain embodiments, the density of the fuel composition disclosed herein is measured according to ASTM Standard D 4052. In further embodiments, the density of the fuel composition disclosed herein is measured according to any conventional method known to a skilled artisan for measuring density of fuels.

In some embodiments, the fuel composition has a freezing point that is lower than −30° C., lower than −40° C., lower than −50° C., lower than −60° C., lower than −70° C., or lower than −80° C. In other embodiments, the fuel composition has a freezing point from about −80° C. to about −30° C., from about −75° C. to about −35° C., from about −70° C. to about −40° C., or from about −65° C. to about −45° C. In certain embodiments, the freezing point of the fuel composition disclosed herein is measured according to ASTM Standard D 2386. In further embodiments, the freezing point of the fuel composition disclosed herein is measured according to any conventional method known to a skilled artisan for measuring freezing point of fuels.

In some embodiments, the fuel composition has a density at 15° C. from about 750 kg/m$^3$ to about 850 kg/m$^3$, and a flash point equal to or greater than 38° C. In certain embodiments, the fuel composition has a density at 15° C. from about 750 kg/m$^3$ to about 850 kg/m$^3$, a flash point equal to or greater than 38° C., and a freezing point lower than −40° C. In certain embodiments, the fuel composition has a density at 15° C. from about 750 kg/m$^3$ to about 840 kg/m$^3$, a flash point equal to or greater than 38° C., and a freezing point lower than −40° C.

In some embodiments, the fuel composition has an initial boiling point that is from about 140° C. to about 170° C. In other embodiments, the fuel composition has a final boiling point that is from about 180° C. to about 300° C. In still other embodiments, the fuel composition has an initial boiling that is from about 140° C. to about 170° C., and a final boiling point that is from about 180° C. to about 300° C. In certain embodiments, the fuel composition meets the distillation specification of ASTM D 86.

In some embodiments, the fuel composition has a Jet Fuel Thermal Oxidation Tester (JFTOT) temperature that is equal to or greater than 245° C. In other embodiments, the fuel composition has a JFTOT temperature that is equal to or greater than 250° C., equal to or greater than 255° C., equal to or greater than 260° C., or equal to or greater than 265° C.

In some embodiments, the fuel composition has a viscosity at −20° C. that is less than 6 mm$^2$/sec, less than 7 mm$^2$/sec, less than 8 mm$^2$/sec, less than 9 mm$^2$/sec, or less than 10 mm$^2$/sec. In certain embodiments, the viscosity of the fuel composition disclosed herein is measured according to ASTM Standard D 445.

In certain other embodiments, the fuel composition has a density at 15° C. of between 750 and 840 kg/m$^3$, has a flash point that is equal to or greater than 38° C.; and freezing point that is lower than −40° C. In still other embodiments, the petroleum-based fuel is Jet A and the fuel composition meets the ASTM D 1655 specification for Jet A. In some embodiments, the fuel composition is a Fischer-Tropsch-based fuel that meets the ASTM D 1655 specification for Jet A. In still other embodiments, the petroleum-based fuel is Jet A-1 and the fuel composition meets the ASTM D 1655 specification for Jet A-1. In some embodiments, the fuel composition is a Fischer-Tropsch-based fuel that meets the ASTM D 1655 specification for Jet A-1. In still other embodiments, the petroleum-based fuel is Jet B and the fuel composition meets the ASTM D 1655 specification for Jet B. In some embodiments, the fuel composition is a Fischer-Tropsch-based fuel that meets the ASTM D 1655 specification for Jet B.

In another aspect, provided herein are fuel compositions comprising (a) limonane in an amount that is between about 15% and about 60% by volume; (b) farnesane in an amount that is between about 5% and about 45% by volume; (c) p-cymene in an amount that is from about 0.5% to about 25% by volume; and (d) a petroleum-based fuel or a synthetic fuel, e.g., a Fischer-Tropsch-based fuel, in an amount that is at least 20% by volume, wherein all amounts are based on the total volume of the fuel composition and the fuel composition has a density from about 750 kg/m$^3$ to about 840 kg/m$^3$ at 15° C., and a difference between $T_{90}$ and $T_{10}$ temperatures of least 10° C.

In other embodiments, the difference between $T_{90}$ and $T_{10}$ temperatures is least 20° C., is at least 30° C., is at least 40° C., is at least 50° C., is at least 60° C., is at least 70° C., or is greater than 75° C.

In another aspect, provided herein are fuel compositions comprising (a) limonane in an amount that is between about 15% and about 30% by volume; (b) farnesane in an amount that is between about 10% and about 30% by volume; (c) p-cymene in an amount that is from about 0.5% to about 20% by volume; (d) a petroleum-based fuel or a synthetic fuel, e.g., a Fischer-Tropsch-based fuel, in an amount that is at least 40% by volume; and (e) a fuel additive, wherein all amounts are based on the total volume of the fuel composition and the fuel composition has a density from about 750 kg/m$^3$ to about 840 kg/m$^3$ at 15° C., a flash point equal to or greater than 38° C., a freezing point lower than −40° C., and a difference between $T_{90}$ and $T_{10}$ temperatures of least 10° C. In some embodiments, the fuel additive is at least one additive selected from the group consisting of an oxygenate, an antioxidant, a thermal stability improver, a stabilizer, a cold flow improver, a combustion improver, an anti-foam, an anti-haze additive, a corrosion inhibitor, a lubricity improver, an icing inhibitor, an injector cleanliness additive, a smoke suppressant, a drag reducing additive, a metal deactivator, a dispersant, a detergent, a de-emulsifier, a dye, a marker, a static dissipater, a biocide, and combinations thereof. In other embodiments, the fuel additive is an antioxidant.

In other embodiments, the above described fuel composition meets the ASTM D 1655 specification for Jet A-1. In other embodiments, the fuel composition meets the ASTM D 1655 specification for Jet A. In still other embodiments, the fuel composition meets the ASTM D 1655 specification for Jet B.

In another aspect, provided herein are fuel compositions consisting essentially of limonane, farnesane, and cymene.

Applications of Fuel Compositions

The fuel composition disclosed herein can be stored in or received by a fuel container such as a fuel tank. A fuel tank is generally a safe container for flammable liquids. In some embodiments, the fuel tank is a part of a combustion engine system in which a fuel is stored and propelled by a fuel pump or released in pressurized gas form into a combustion engine. Any fuel tank that can store or receive one or more liquid fuels can be used herein. Some non-limiting examples of suitable fuel containers include vehicle fuel tanks such as automobile fuel tanks and aircraft fuel tanks; fuel tanks above ground or in the ground (e.g., at a fueling station), tanks on transportation vehicles such as tanker trucks, tanker trains, and tanker ships. In certain embodiments, the fuel tank may be connected to other equipments or devices such as power tools, generators and internal combustion engines.

The fuel tanks may vary in size and complexity from small plastic tanks of a butane lighter to the multi-chambered cryogenic Space Shuttle external tank. The fuel tank may be made of a plastic such as polyethylenes (e.g., HDPE and UHDPE) or a metal such as steel or aluminum.

In some embodiments, the fuel composition disclosed here is stored in an aircraft fuel tank and propelled by a fuel pump or released in pressurized gas form into a internal combustion engine to power an aircraft. The aircraft fuel tank can be an integral fuel tank, rigid removable fuel tank, a bladder fuel tank or a combination thereof.

In certain embodiments, the fuel tank is an integral tank. The integral tank is generally an area inside the aircraft structure that have been sealed to allow fuel storage. An example of this type is the "wet wing" generally used in larger aircraft. Most large transport aircraft generally use the integral tank which stores fuel in the wings and/or tail of the airplane.

In some embodiments, the fuel tank is a rigid removable tank. The rigid removable tank is generally installed in a compartment designed to accommodate the tank. They generally are made of metal, and may be removed for inspection, replacement, or repair. The aircraft does not rely on the tank for structural integrity. These tanks are generally found in smaller general aviation aircraft.

In certain embodiments, the fuel tank is a bladder tank. The bladder tank is generally reinforced rubberized bags installed in a section of aircraft structure designed to accommodate the weight of the fuel. The bladder tank may be rolled up and installed into the compartment through the fuel filler neck or access panel, and may be secured by means of metal buttons or snaps inside the compartment. The bladder tank is generally found in many high-performance light aircraft and some smaller turboprops.

The fuel composition disclosed herein can be used to power any equipment such as an emergency generator or internal combustion engine, which requires a fuel such as jet fuels or missile fuels. An aspect of the present invention provides a fuel system for providing an internal combustion engine with a fuel wherein the fuel system comprises a fuel tank containing the fuel composition disclosed herein. Optionally, the fuel system may further comprise an engine cooling system having a recirculating engine coolant, a fuel line connecting the fuel tank with the internal combustion engine, and/or a fuel filter arranged on the fuel line. Some non-limiting examples of internal combustion engines include reciprocating engines (e.g., gasoline engines and diesel engines), Wankel engines, jet engines, some rocket engines and gas turbine engines.

In some embodiments, the fuel tank is arranged with said cooling system so as to allow heat transfer from the recirculating engine coolant to the fuel composition contained in the fuel tank. In other embodiments, the fuel system further comprises a second fuel tank containing a second fuel for a jet engine and a second fuel line connecting the second fuel tank with the engine. Optionally, the first and second fuel lines can be provided with electromagnetically operated valves that can be opened or closed independently of each other or simultaneously. In further embodiments, the second fuel is a Jet A.

In another aspect, an engine arrangement is provided comprising an internal combustion engine, a fuel tank containing the fuel composition disclosed herein, a fuel line connecting the fuel tank with the internal combustion engine. Optionally, the engine arrangement may further comprise a fuel filter and/or an engine cooling system comprising a recirculating engine coolant. In some embodiments, the internal combustion engine is a diesel engine. In other embodiments, the internal combustion engine is a jet engine.

When using the fuel composition disclosed herein, it is desirable to remove particulate matter originating from the fuel composition before injecting it into the engine. Therefore, it is desirable to select a suitable fuel filter for use in the fuel system disclosed herein. Water in fuels used in an internal combustion engine, even in small amounts, can be very harmful to the engine. Therefore, it is desirable that water present in fuel composition can be removed prior to injection into the engine. In some embodiments, water and particulate matter can be removed by the use of a fuel filter utilizing a turbine centrifuge, in which water and particulate matter are separated from the fuel composition to an extent allowing injection of the filtrated fuel composition into the engine, without risk of damage to the engine. Other types of fuel filters that can remove water and/or particulate matter may of course also be used.

Another aspect of the invention provides a vehicle comprising an internal combustion engine, a fuel tank containing the fuel composition disclosed herein, a fuel line connecting the fuel tank with the internal combustion engine. Optionally, the vehicle may further comprise a fuel filter and/or an engine cooling system comprising a recirculating engine coolant. Some non-limiting examples of vehicles include cars, motorcycles, trains, ships, and aircraft.

In another aspect, a vehicle is provided comprising an internal combustion engine, a fuel tank containing the fuel composition disclosed herein, and a fuel line connecting the fuel tank with the internal combustion engine. Optionally, the vehicle may further comprise a fuel filter and/or an engine cooling system comprising a recirculating engine coolant. Some non-limiting examples of vehicles include cars, motorcycles, trains, ships, and aircraft.

Methods for Making Limonane, Farnesane, and Cymene

In addition to the Examples herein, the isoprenoid starting materials can be made by any method known in the art including biological methods, chemical syntheses, and hybrid methods. When the isoprenoid starting material is made biologically, host cells that are modified to produce the desired product can be used. Limonane may be made by the hydrogenation of a variety of isoprenoid starting materials such as limonene, β-phellandrene, γ-terpinene, terpinolene. Methods for making limonene, β-phellandrene, γ-terpinene, terpinolene as well as their hydrogenation into limonane have been described by PCT Publication No. WO 2007/140339, U.S. application Ser. Nos. 11/986,484 and 11/986,485, and international application nos. PCT/US2007/024270 and PCT/US2007/024266, which are incorporated herein by reference in their entireties. Farnesane may be made by the hydrogenation of isoprenoid starting materials α- and β-farnesene. Methods for making α- and β-farnesenes and their hydrogenation into farnesane is described by U.S. Pat. No. 7,399,323 which is incorporated by reference in its entirety. Cymene may be made by hydrogenation of limonane and is also described by U.S. application Ser. Nos. 11/986,484 and 11/986,485, and international application nos. PCT/US2007/024270 and PCT/US2007/024266, which are hereby incorporated by reference in their entireties.

Business Methods

One aspect of the present invention relates to a business method comprising: (a) obtaining a biofuel comprising limonane derived from an isoprenoid starting material by performing a fermentation reaction of a sugar with a recombinant host cell, wherein the recombinant host cell produces the isoprenoid starting material; and (b) marketing and/or selling said biofuel.

In other embodiments, the invention provides a method for marketing or distributing the biofuel disclosed herein to marketers, purveyors, and/or users of a fuel, which method comprises advertising and/or offering for sale the biofuel disclosed herein. In further embodiments, the biofuel disclosed herein may have improved physical or marketing characteristics relative to the natural fuel or ethanol-containing biofuel counterpart.

In certain embodiments, the invention provides a method for partnering or collaborating with or licensing an established petroleum oil refiner to blend the biofuel disclosed herein into petroleum-based fuels such as a gasoline, jet fuel, kerosene, diesel fuel or a combination thereof. In another embodiment, the invention provides a method for partnering or collaborating with or licensing an established petroleum oil refiner to process (for example, hydrogenate, hydrocrack, crack, further purify) the biofuels disclosed herein, thereby modifying them in such a way as to confer properties beneficial to the biofuels. The established petroleum oil refiner can use the biofuel disclosed herein as a feedstock for further chemical modification, the end product of which could be used as a fuel or a blending component of a fuel composition.

In certain embodiments, the invention provides a method for partnering or collaborating with or licensing an established synthetic fuel producer to blend the biofuel disclosed herein into synthetic fuels such as a Fischer-Tropsch-based fuel, turbodiesel, CTL synthetic jet fuel or a combination thereof. In another embodiment, the invention provides a method for partnering or collaborating with or licensing an established synthetic fuel producer to process (for example, hydrogenate, hydrocrack, crack, further purify) the biofuels disclosed herein, thereby modifying them in such a way as to confer properties beneficial to the biofuels. The established synthetic fuel producer can use the biofuel disclosed herein as a feedstock for further chemical modification, the end product of which could be used as a fuel or a blending component of a fuel composition.

In further embodiments, the invention provides a method for partnering or collaborating with or licensing a producer of sugar from a renewable resource (for example, corn, sugar cane, bagass, or lignocellulosic material) to utilize such renewable sugar sources for the production of the biofuels disclosed herein. In some embodiments, corn and sugar cane, the traditional sources of sugar, can be used. In other embodiments, inexpensive lignocellulosic material (agricultural waste, corn stover, or biomass crops such as switchgrass and pampas grass) can be used as a source of sugar. Sugar derived from such inexpensive sources can be fed into the production of the biofuel disclosed herein, in accordance with the methods of the present invention.

In certain embodiments, the invention provides a method for partnering or collaborating with or licensing a chemical producer that produces and/or uses sugar from a renewable resource (for example, corn, sugar cane, bagass, or lignocellulosic material) to utilize sugar obtained from a renewable resource for the production of the biofuel disclosed herein.

EXAMPLES

The following examples are intended for illustrative purposes only and do not limit in any way the scope of the present invention.

The practice of the present invention can employ, unless otherwise indicated, conventional techniques of the biosynthetic industry and the like, which are within the skill of the art. To the extent such techniques are not described fully herein, one can find ample reference to them in the scientific literature.

In the following examples, efforts have been made to ensure accuracy with respect to numbers used (for example, amounts, temperature, and so on), but variation and deviation can be accommodated, and in the event a clerical error in the numbers reported herein exists, one of ordinary skill in the arts to which this invention pertains can deduce the correct amount in view of the remaining disclosure herein. Unless indicated otherwise, temperature is reported in degrees Celsius, and pressure is at or near atmospheric pressure at sea level. All reagents, unless otherwise indicated, were obtained commercially. The following examples are intended for illustrative purposes only and do not limit in any way the scope of the present invention.

Example 1

This example describes the hydrogenation of α-farnesene to farnesane. α-Farnesene (204 g, 1 mole, 255 mL) was added to a 500 mL Parr high pressure vessel containing 10% Pd/C (5 g, 5% by weight of α-farnesene). The reaction vessel was sealed and evacuated under house vacuum for 5 minutes after which time the reaction mixture was pressurized with $H_2$ to 35 psi at 25° C. The reaction mixture was shaken until no further drop in the $H_2$ pressure was observed (approximately 16 hours). The excess $H_2$ gas was removed under house vacuum followed by venting to a $N_2$ atmosphere. Thin layer chromatography ("TLC", $R_f$=0.95, hexane, p-anisaldehyde stain or iodine) indicated the complete disappearance of the reactant. The reaction contents were vacuum filtered over a silica gel (60 Å from Aldrich) pad followed by washing of the silica gel with hexane (2 L). The filtrate was concentrated on a rotary evaporator. The isolated product was further dried under high vacuum to remove any residual hexane to afford farnesane as a colorless liquid (195 g, 244 mL, 95%). 1H-NMR ($CDCl_3$, 500 MHz): δ 1.56-1.11 (m, 17H), 0.88-0.79 (overlapping t&d, 15H).

Example 2

This example describes the hydrogenation of β-farnesene to farnesane.

Into a 2-gallon reactor, 4 kg (4.65 L=1.23 gal) of farnesene liquid was added 75 g of 10 wt. % Pd/C (dry) catalyst. This gave an initial catalyst loading of 16.13 g/L. The vessel was sealed, purged with nitrogen gas, then evacuated under vacuum. Stirring was initiated and compressed hydrogen gas was added continuously at 100 psig. The reactor was heated to 80° C. Total reaction time was approximately 48 hours. Using GC-FID the final farnesane concentration was measured to be 99.76%. The reactor was cooled, vented, and opened. The reaction mixture was then filtered through a 0.5 micron filter cartridge into two 1-gal glass bottles.

If desired, the product can be further purified by distillation. An exemplary 1 L distillation protocol is as follows. Approximately 1 L of farnesane was charged to a 2 L round-bottom flask with a water cooled distillation head along with a Vigreaux column attached to the joint. The liquid was stirred and evacuated to 14 Torr. At this point, the liquid was heated to 155° C. and the flask was wrapped in glass wool along with aluminum foil. During heating, the liquid turned from clear to light yellow. Vapor started to come over the head at 120° C. Approximately 950 mL of the clear farnesane was collected before the distillation was stopped.

Example 3

This example describes the hydrogenation of limonene to primarily limonane.

To a reaction vessel, limonene and 10% Pd/C catalyst [palladium, 10 wt. % on activated carbon, Aldrich #205699] are added at 6 g/L loading. The vessel is sealed and purged with nitrogen gas, then evacuated under vacuum. To begin the reaction, the vessel is stirred while adding compressed hydrogen gas at 80 psig. The mildly exothermic reaction proceeds at room temperature. Final conversion is about 100%, marked by end of hydrogen consumption and verified by gas chromatography with flame ionization detection. The product-catalyst mixture is separated via gravity filtration through a 60 Å silica gel. The final product concentration is expected to be mostly limonane with less than 5% p-cymene.

Example 4

This example describes the hydrogenation of limonene to mostly limonane with some p-cymene.

To the reaction vessel, limonene and 10% Pd/C catalyst [palladium, 10 wt. % on activated carbon, Aldrich #205699] are added at 6 g/L loading. The vessel is sealed, purged with nitrogen gas, then evacuated under vacuum. The vessel is stirred while increasing the temperature to 105° C. An initial charge of compressed hydrogen gas is added at 80 psig and totaling approximately 0.05 mol hydrogen per mol limonene. Due to hydrogen consumption, pressure will drop to zero. After 12 hours reaction time, the temperature is decreased to 75° C. and continuously added compressed hydrogen at 80 psig. Final conversion is about 100%, marked by end of hydrogen consumption and verified by gas chromatography with flame ionization detection. The product-catalyst mixture is separated via gravity filtration through a 60 Å silica gel. The final product concentration is expected to be between about 80% and about 90% limonane and between about 10% and about 20% p-cymene.

Example 5

This example describes the hydrogenation of limonene to limonane and p-cymene.

To the reaction vessel, limonene and 10% Pd/C catalyst [palladium, 10 wt. % on activated carbon, Aldrich #205699] are added at 6 g/L loading. The vessel is sealed, purged with nitrogen gas, then evacuated under vacuum. The vessel is stirred while increasing the temperature to 120° C. An initial charge of compressed hydrogen gas is added at 80 psig and totaling approximately 0.05 mol hydrogen per mol limonene. Due to hydrogen consumption, pressure will drop to zero. The initial charge of hydrogen allows for the formation of 4-isopropyl-1-methylcyclohex-1-ene which then is readily converted to p-cymene. After 12 hours reaction time, temperature is decreased to 75° C. and compressed hydrogen is continuously added at 80 psig. Final conversion is about 100%, marked by end of hydrogen consumption and verified by gas chromatography with flame ionization detection. The product-catalyst mixture is separated via gravity filtration through a 60 Å silica gel. Final product concentration is expected to be between about 70% and 80% limonane and between about 20% and about 30% p-cymene.

Example 6

Three fuel compositions referred to as AMD-200, AMJ-300 and AMJ-310 were tested in various ASTM tests for D 1655 for Jet A. AMD-200 comprises 99.76% farnesane. AMJ-300 comprises 97.1% limonane and 1.6% p-cymene. AMJ-300 includes 1.3% of unidentified compounds, of which 0.9% is believed to be 2,6-dimethyloctane. AMJ-310 comprises 81.0% limonane and 17.5% p-cymene is blended with 0%, 50% and 80% Jet A. AMJ-310 includes 1.5% of unidentified compounds, of which 0.9% is believed to be 2,6-dimethyloctane. The components of AMD-200, AMJ-300 and AMJ-310 were identified by gas chromatography/flame ionization detector (GC/FID).

As shown by Table 1, the distillation properties of AMJ-300 and AMJ-310 are similar because limonane and cymene have similar boiling temperatures.

TABLE 1

| Property | Units | | Jet A Spec. | ASTM Test Method | Jet A (Base Fuel) | AMJ-300 | AMJ-310 | AMD-200 |
|---|---|---|---|---|---|---|---|---|
| Distillation temperature | | | | | | | | |
| Initial boiling point, temperature | ° C. | | | D86 | 153 | 154 | 168 | 242 |
| 10% recovered, temperature | ° C. | max. | 205 | D86 | 176 | 168 | 168 | 243 |

TABLE 1-continued

| Property | Units | | Jet A Spec. | ASTM Test Method | Jet A (Base Fuel) | AMJ-300 | AMJ-310 | AMD-200 |
|---|---|---|---|---|---|---|---|---|
| 50% recovered, temperature | ° C. | max. | report | D86 | 209 | 168 | 168 | 244 |
| 90% recovered, temperature | ° C. | max. | report | D86 | 252 | 168 | 169 | 244 |
| Final boiling point, temperature | ° C. | max. | 300 | D86 | 284 | 193 | 201 | 271 |
| Distillation recovery | vol. % | | | D86 | 97.6 | 98.5 | 98.9 | 98.7 |
| Distillation residue | vol. % | max. | 1.5 | D86 | 1.4 | 1.0 | 0.7 | 1.3 |
| Distillation loss | vol. % | max. | 1.5 | D86 | 1.0 | 0.5 | 0.4 | 0.0 |
| Flash Point | ° C. | min. | 38 | D56 | 43 | 43 | 43 | 109 |
| Density at 15° C. | $kg/m^3$ | range | 775-840 | D4052 | 811.0 | 800.9 | 809.6 | 773.7 |
| Freezing point | ° C. | max. | −40 | D2386 | −47 | <−70 | <−70 | <−71 |
| Net heat of combustion | MJ/kg | min. | 42.8 | D4809 | 43.4192 | 42.28 | 44.99 | 44.2 |

Example 7

Figure 2:
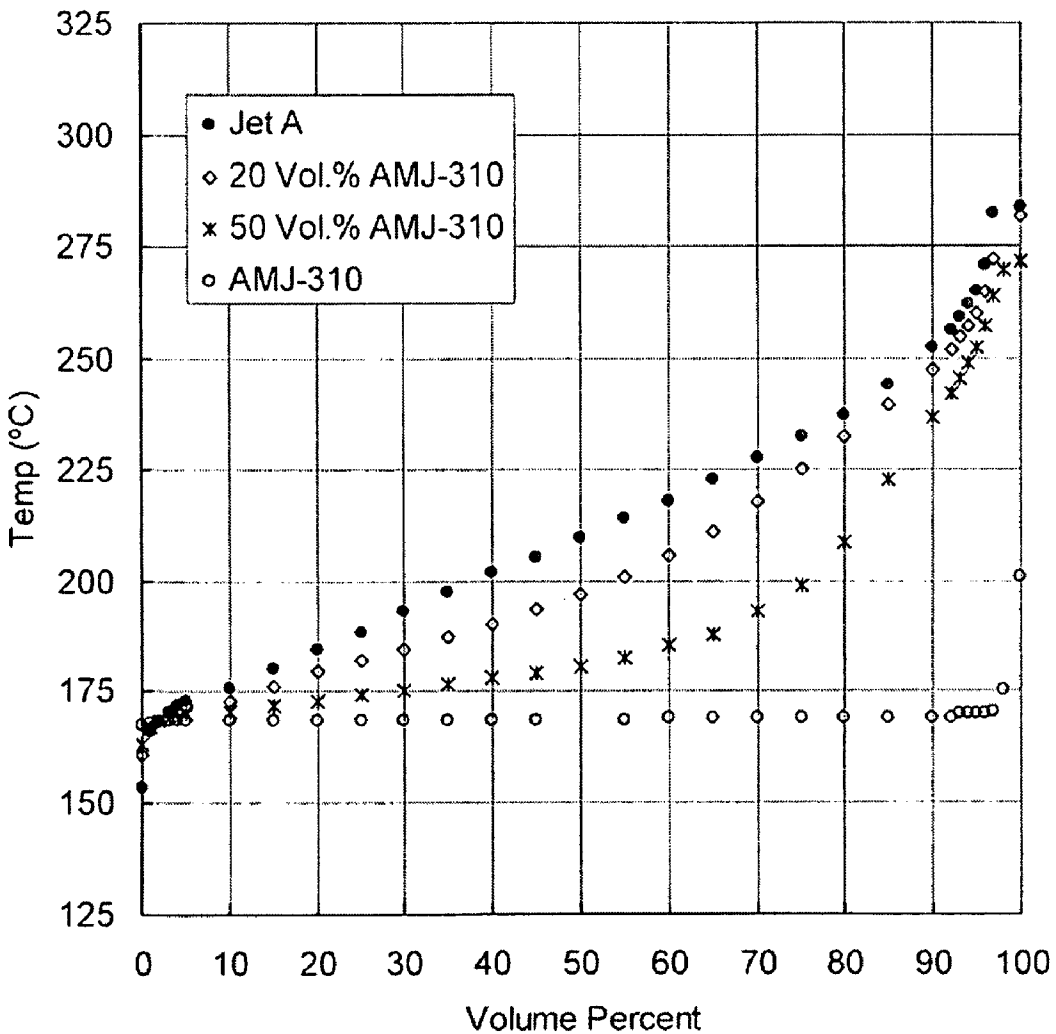
FIG. 2 shows distillation curves for a Jet A and certain blends of Jet A and AMJ-310.

FIGS. 1 and 2 respectively show distillation curves for various blends of AMJ-300 and AMJ-310 with differing amounts of Jet A. A fuel composition (referred to as AMJ-300) comprising 97.1% limonane and 1.6% p-cymene. AMJ-300 includes 1.3% of unidentified compounds, of which 0.9% is believed to be 2,6-dimethyloctane. A fuel composition (referred to as AMJ-310) comprising 81.0% limonane and 17.5% p-cymene was blended with 0%, 50% and 80% Jet A. AMJ-310 includes 1.5% of unidentified compounds, of which 0.9% is believed to be 2,6-dimethyloctane. The components of AMJ-300 and AMJ-310 were identified by gas chromatography/flame ionization detector (GC/FID).

With both AMJ-300 and AMJ-310, the distillation curves deviate from that of Jet A. It is believed that both fuels essentially behave as if they were a single component fuels (with respect to boiling point given the similarities between limonane and cymene).

To better mimic the distillation curve for Jet A (which may comprise many hundreds of compounds), a compound with higher boiling point than limonane and cymene was added. Two new fuel compositions, Fuel A and Fuel B were blended.

Fuel B (also referred to AMJ-700) comprises 50% limonane, 10% cymene and 40% farnesane. Fuel A is 50% AMJ-700 and 50% Jet A thus comprising 25% limonane, 5% cymene, 20% farnesane, and 50% Jet A. Table 2 below shows the D1655 properties for Jet A, Fuel A and Fuel B.

Figure 3:
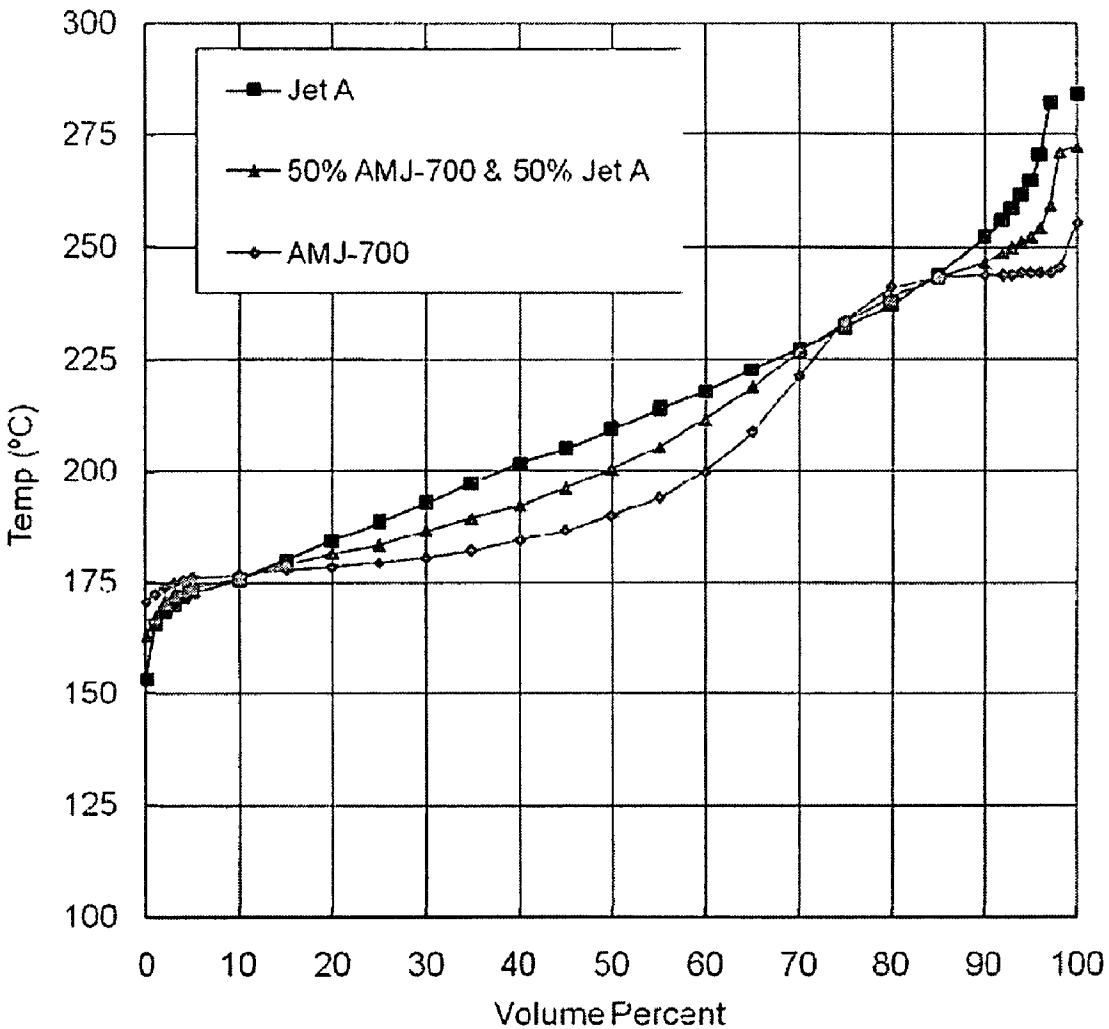
FIG. 3 shows distillation curves for certain embodiments of the fuel compositions disclosed herein.

FIG. 3 shows the distillation curves for Fuel A and B. These fuels blended with Jet A can mimic the distillation curve of Jet A.

TABLE 2

| PROPERTY/COMPOSITION | Units | | Jet A Spec. | ASTM Test Method | Jet A (Base Fuel) | Fuel A | Fuel B |
|---|---|---|---|---|---|---|---|
| Appearance | | | C & B* | D4176-2 | C & B* | C & B* | C & B* |
| Acidity | total mg KOH/g | max. | 0.10 | D3242 | 0.005 | 0.003 | 0.003 |
| Aromatics | vol. % | max. | 25 | D1319 | 16.9 | 16.5 | 9.1 |
| Sulfur | total mass % | max. | 0.30 | D4294 | 0.0685 | 0.0351 | 0.0006 |
| Sulfur, mercaptan | mass % | max. | 0.003 | D3227 | 0.0019 | 0.0005 | <0.0001 |
| VOLATILITY | | | | | | | |
| Physical Distillation - Distillation temperature | | | | | | | |
| Initial boiling point, temperature | ° C. | max. | | D86 | 153 | 163 | 171 |
| 10% recovered, temperature | ° C. | max. | 205 | D86 | 176 | 177 | 177 |
| 50% recovered, temperature | ° C. | max. | report | D86 | 209 | 201 | 191 |
| 90% recovered, temperature | ° C. | max. | report | D86 | 252 | 247 | 244 |
| Final boiling point, temperature | ° C. | max. | 300 | D86 | 284 | 272 | 256 |
| Distillation recovery | vol. % | | | D86 | 97.6 | 98.1 | 99 |
| Distillation residue | vol. % | max. | 1.5 | D86 | 1.4 | 1.4 | 0.6 |
| Distillation loss | vol. % | max. | 1.5 | D86 | 1.0 | 0.5 | 0.4 |
| Flash Point | ° C. | min. | 38 | D56 | 43 | 48 | 50 |
| Density at 15° C. | $kg/m^3$ | range | 775-840 | D4052 | 811.0 | 802.7 | 795.6 |
| FLUIDITY | | | | | | | |
| Freezing point | ° C. | max. | −40 | D2386 | −47 | −53.5 | <−71 |

*Note: C & B means clear & bright.

Comparative Example A

Comparative Example A was a Jet A-1 provided by the Air Force Research Laboratory (Dayton, Ohio).

Example 8

Example 8 was AMJ-310. AMJ-310 comprises 81.0% limonane and 17.5% p-cymene was blended with 0%, 50% and 80% Jet A. AMJ-310 includes 1.5% of unidentified compounds, of which 0.9% is believed to be 2,6-dimethyloctane.

Example 9

Example 9 was a fuel composition prepared by mixing 50% AMJ-310 and 50% JET A-1.

Example 10

Example 10 was a fuel composition prepared by mixing 50% AMJ-700 and 50% JET A-1. AMJ-700 (Fuel B) comprises 50% limonane, 10% cymene and 40% farnesane. Fuel A is 50% AMJ-700 and 50% Jet A thus comprising 25% limonane, 5% cymene, 20% farnesane, and 50% Jet A.

Example 11

Example 11 was a fuel composition prepared by mixing 10% AMJ-310 and 90% JET A-1.

Light Off Test

Examples 8-11 were tested in a key combustor rig test, namely the light-off test. Light off occurs when the speed of an engine produces enough combustion air to produce the correct ratio of air with the fuel supplied. Due to the fact that fuel flow is highly dependent upon ambient conditions including both ambient temperature and ambient atmospheric pressure, the amount of fuel flow to the gas turbine engine is actively controlled as a function of the speed of the gas turbine engine in order to achieve the correct fuel-to-air ratio for light-off. The fuel and combustor air temperature for all tests ($T_3$) were −30 F. The light-off test was conducted at various burner pressure drop, i.e., dP/P. While the nominal dP/P condition for the testing combustor is between 4.5 and 4.7%, the dP/P condition for the light-off test started at a low condition of 2%. Subsequently, the dP/P condition was increased to medium (4%) and high (6%) conditions. Since dP/P is a measure of air flow, higher dP/P condition is equivalent to higher airflow. Amount of fuel flow for Jet A-1 required to execute light off was set as a baseline, and changes in the fuel flow of Examples 8-11 required to execute light off were measured.

Figure 4:
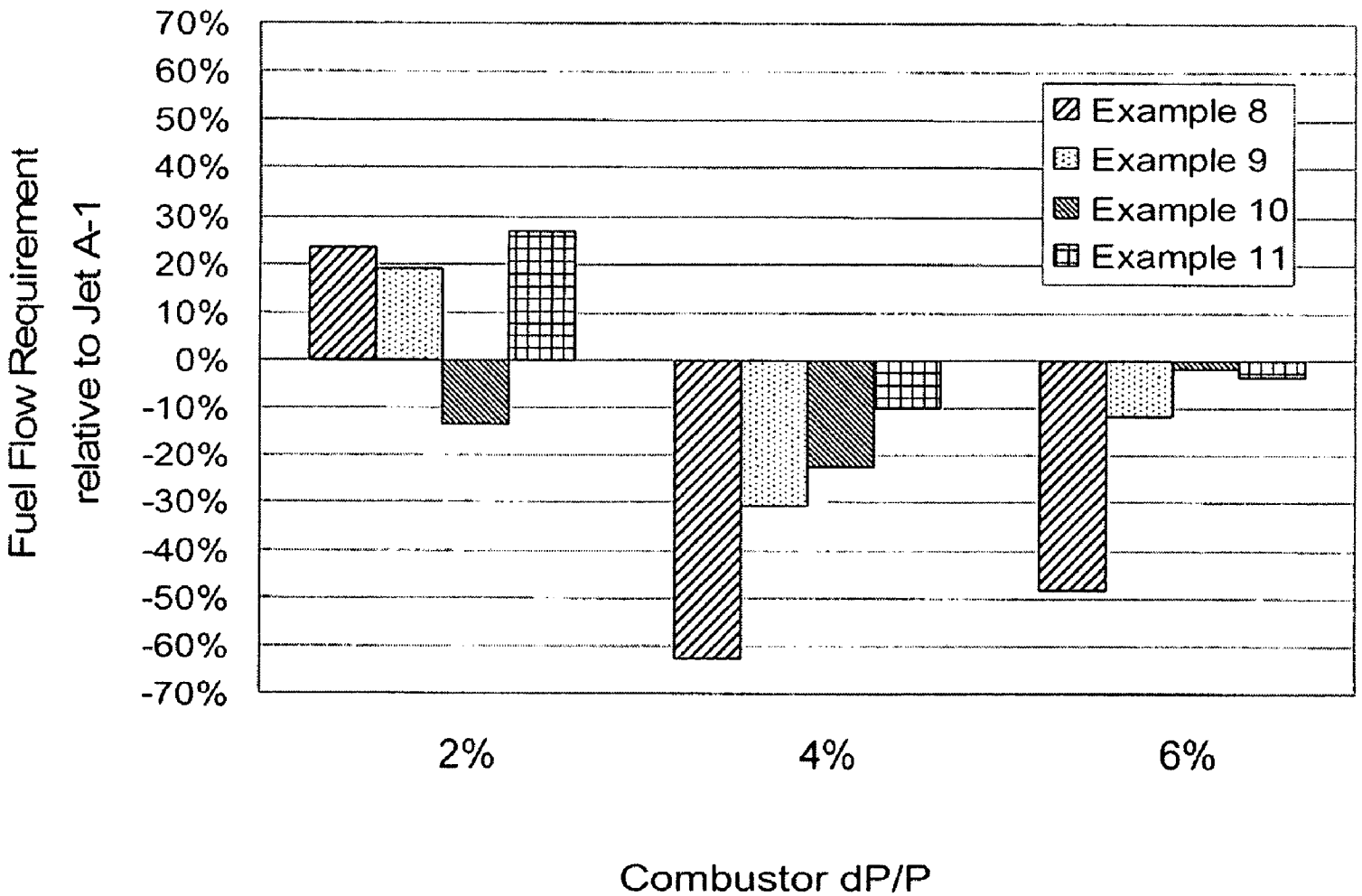
FIG. 4 shows the relative fuel flow required to execute light off at different burner pressure drop (dP/P) for certain embodiments of fuel compositions disclosed herein. Comparison is made with reference to fuel flow required to execute light off for Jet A-1.

FIG. 4 shows the fuel flow required to execute light off at different dP/P ratios for Examples 8-11 relative to the fuel flow required to execute light off for a Jet A-1. Since reduced fuel flow requirement of a certain fuel component can be a positive result, as shown in FIG. 4, Examples 8, 9 and 11 perform better than Jet A-1 at medium and high dP/P conditions, but slightly worse than Jet A-1 at low dP/P condition. Example 10 performs better than Jet A-1 at all dP/P conditions.

Lean Blowout Test

Four fuel compositions referred to as Examples 8-11 were tested in a combustor rig test, namely the lean blowout test. The lean blowout (LBO) fuel/air ratio is a design requirement for gas turbine fuel injectors that must be met during the development process. Normally LBO fuel/air ratio of a combustor should be maintained to avoid blowout during rapid engine deceleration at altitude, as well as to maintain combustion during altitude relight. Amount of fuel flow for Jet A-1 required for lean blowout was set as a baseline, and changes in the fuel flow of Examples 8-11 required for lean blowout were measured.

Figure 5:
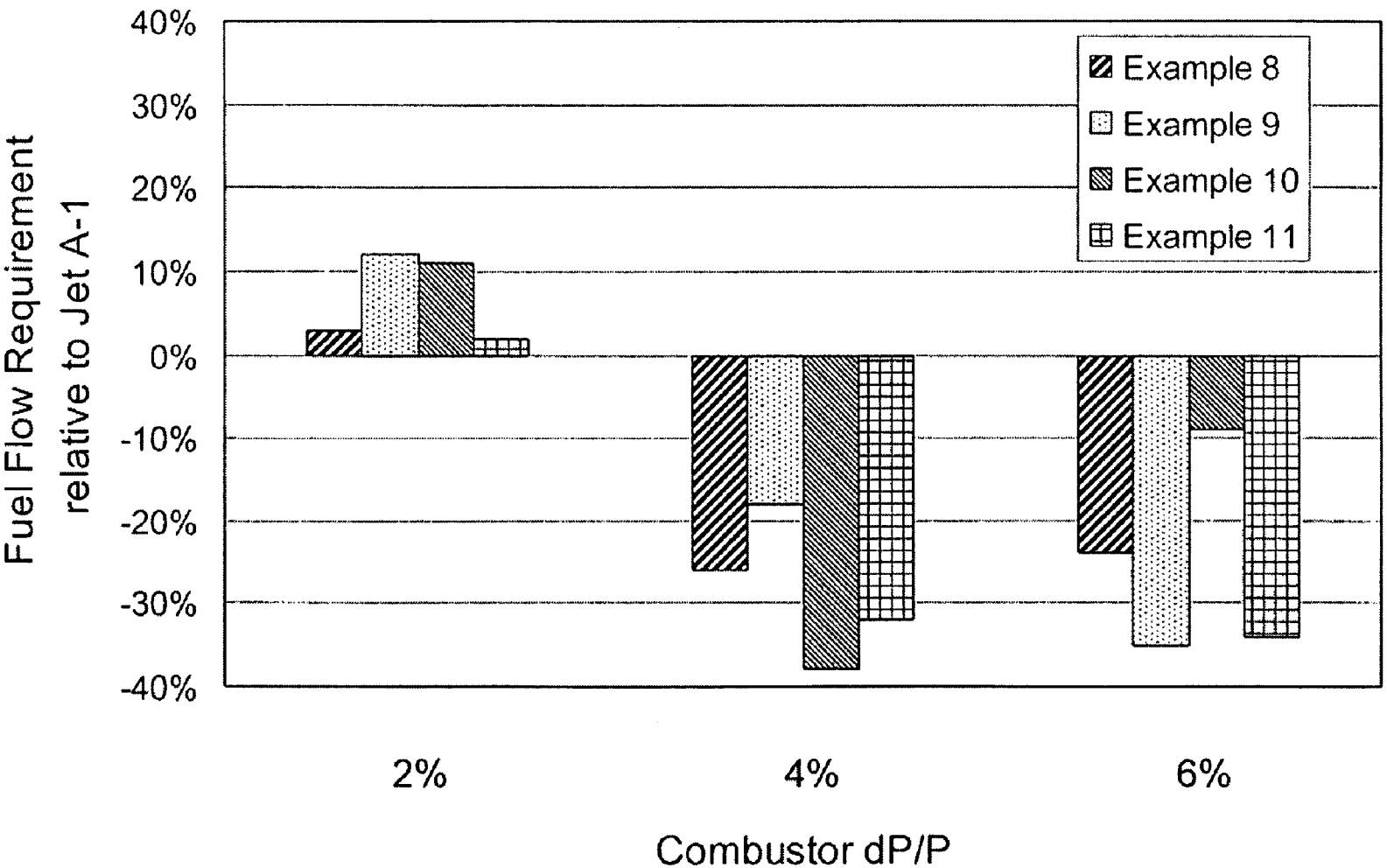
FIG. 5 shows relative fuel flow required to execute lean blowout at different burner pressure drop (dP/P) for certain embodiments of fuel compositions disclosed herein. Comparison is made with reference to fuel flow required to execute lean blowout for Jet A-1.

FIG. 5 shows the lean blowout for certain embodiments of the fuel compositions disclosed herein relative to that for Jet A-1 under different rates of pressure rise. As shown in FIG. 5, Examples 8-11 perform better than Jet A-1 at medium and high dP/P conditions, but slightly worse than Jet A-1 at low dP/P condition. Example 10 comprising 50% limonane and 40% farnesane performs better than Examples 8, 9 and 11 at medium dP/P condition.

While the invention has been described with respect to a limited number of embodiments, the specific features of one embodiment should not be attributed to other embodiments of the invention. No single embodiment is representative of all aspects of the claimed subject matter. In some embodiments, the compositions or methods may include numerous compounds or steps not mentioned herein. In other embodiments, the compositions or methods do not include, or are substantially free of, any compounds or steps not enumerated herein. Variations and modifications from the described embodiments exist. It should be noted that the application of the jet fuel compositions disclosed herein is not limited to jet engines; they can be used in any equipment which requires a jet fuel. Although there are specifications for most jet fuels, not all jet fuel compositions disclosed herein need to meet all requirements in the specifications. It is noted that the methods for making and using the jet fuel compositions disclosed herein are described with reference to a number of steps. These steps can be practiced in any sequence. One or more steps may be omitted or combined but still achieve substantially the same results. The appended claims intend to cover all such variations and modifications as falling within the scope of the invention.

All publications and patent applications mentioned in this specification are herein incorporated by reference to the same extent as if each individual publication or patent application was specifically and individually indicated to be incorporated by reference. Although the foregoing invention has been described in some detail by way of illustration and example for purposes of clarity of understanding, it will be readily apparent to those of ordinary skill in the art in light of the teachings of this invention that certain changes and modifications may be made thereto without departing from the spirit or scope of the appended claims.

What is claimed is:

1. A fuel composition comprising:

(a) limonane in an amount that is at least 5% by volume, based on the total volume of the fuel composition; and (b) farnesane in an amount that is at least 5% by volume, based on the total volume of the fuel composition.

2. The fuel composition of claim 1, wherein the density of the fuel composition at 15° C. is from about 775 kg/m$^3$ to about 840 kg/m$^3$.

3. The fuel composition of claim 1, wherein the fuel composition further comprises p-cymene in an amount that is at least 0.5% by volume, based on the total volume of the fuel composition.

4. The fuel composition of claim 1, wherein the fuel composition further comprises a petroleum-based fuel.

5. The fuel composition of claim 1 wherein the fuel composition further comprises a Fischer-Tropsch-based fuel.

6. The fuel composition of claim 1 wherein the farnesane is

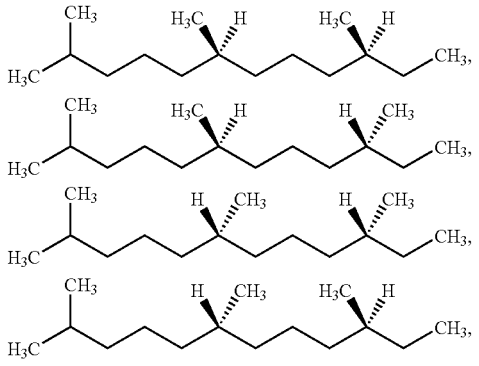

or a combination thereof.

7. The fuel composition of claim 1, wherein the limonane is

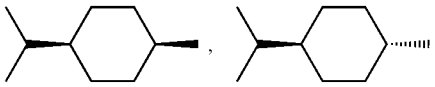

or a combination thereof.

8. The fuel composition of claim 1, wherein the fuel composition further comprises a fuel additive selected from the group consisting of an oxygenate, an antioxidant, a thermal stability improver, a stabilizer, a cold flow improver, a combustion improver, an anti-foam, an anti-haze additive, a corrosion inhibitor, a lubricity improver, an icing inhibitor, an injector cleanliness additive, a smoke suppressant, a drag reducing additive, a metal deactivator, a dispersant, a detergent, a de-emulsifier, a dye, a marker, a static dissipater, a biocide, and combinations thereof.

9. The fuel composition of claim 1, comprising:

(a) limonane in an amount that is from about 15% to about 60% by volume;

(b) farnesane in an amount that is from about 5% to about 45% by volume;

(c) p-cymene in an amount that is from about 0.5% to about 25% by volume; and (d) a petroleum-based fuel or a Fischer-Tropsch-based fuel in an amount that is at least 20% by volume, wherein all amounts are based on the total volume of the fuel composition.

10. The fuel composition of claim 9, wherein the fuel composition has a density from about 750 kg/m$^3$ to about 840 kg/m$^3$ at 15° C., and a difference between $T_{90}$ and $T_{10}$ temperatures of at least 10° C.

11. The fuel composition of claim 9, wherein the limonane is

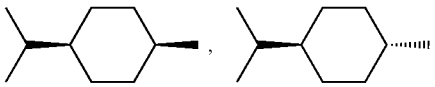

or a combination thereof.

12. The fuel composition of claim 9, wherein the farnesane is

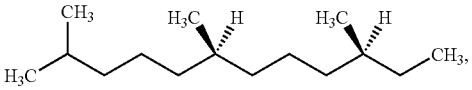

-continued

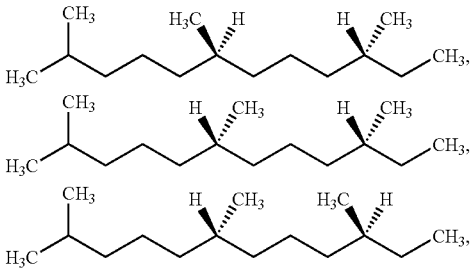

or a combination thereof.

13. The fuel composition of claim 9, that comprises a petroleum-based fuel selected from kerosene, Jet A, Jet A-1, Jet B and combinations thereof.

14. The fuel composition of claim 1, comprising:

(a) limonane in an amount that is from about 15% to about 30% by volume;

(b) farnesane in an amount that is from about 10% to about 30% by volume;

(c) p-cymene in an amount that is from about 0.5% to about 20% by volume;

(d) a petroleum-based fuel or a Fischer-Tropsch-based fuel in an amount that is at least 40% by volume; and (e) a fuel additive, wherein all amounts are based on the total volume of the fuel composition.

15. The fuel composition of claim 14, wherein the fuel composition has a density from about 750 kg/m$^3$ to about 840 kg/m$^3$ at 15° C., and a difference between $T_{90}$ and $T_{10}$ temperatures of at least 10° C.

16. The fuel composition of claim 14, wherein the fuel additive is at least one additive selected from the group consisting of an oxygenate, an antioxidant, a thermal stability improver, a stabilizer, a cold flow improver, a combustion improver, an anti-foam, an anti-haze additive, a corrosion inhibitor, a lubricity improver, an icing inhibitor, an injector cleanliness additive, a smoke suppressant, a drag reducing additive, a metal deactivator, a dispersant, a detergent, a de-emulsifier, a dye, a marker, a static dissipater, a biocide, and combinations thereof.

17. The fuel composition of claim 14, wherein the fuel additive is an antioxidant.

18. The fuel composition of claim 14, wherein the fuel composition comprises a petroleum-based fuel.

19. The fuel composition of claim 14, wherein the fuel composition meets the ASTM D 1655 specification for Jet A, Jet A-1 or Jet B.

20. The fuel composition of claim 14, wherein the fuel composition comprises a Fischer-Tropsch-based fuel.

* * * * *